US006349640B1

(12) United States Patent
Takebe et al.

(10) Patent No.: US 6,349,640 B1
(45) Date of Patent: Feb. 26, 2002

(54) SEAL TYPE COMPOSITE STENCIL AND PLYCHROME PICTURE FORMING METHOD

(75) Inventors: Saburo Takebe, Takasaki; Mamoru Nomura, Ichikawa; Mamoru Mogi, Tokyo-To; Yoshiyuki Tachikawa, Tokyo-To; Hiroshi Ueda, Tokyo-To, all of (JP)

(73) Assignee: Annex Japan Co., Ltd., Takasaki (JP)

( * ) Notice: Subject to any disclaimer, the term of this patent is extended or adjusted under 35 U.S.C. 154(b) by 0 days.

(21) Appl. No.: 09/629,705

(22) Filed: Jul. 31, 2000

(30) Foreign Application Priority Data

Jul. 30, 1999 (JP) ..... 11-216982

(51) Int. Cl.[7] ..... B41M 1/12; B41M 1/14

(52) U.S. Cl. ..... 101/127; 101/115; 101/128.1; 101/128.21; 101/129

(58) Field of Search ..... 101/115, 127, 101/127.1, 128.1, 128.21, 129; 434/84, 87; 33/562, 563, 565, 613, 623, 645

(56) References Cited

U.S. PATENT DOCUMENTS 2,066,477 A * 1/1937 Levin ..... 101/115
2,293,696 A * 8/1942 Burchell ..... 101/211
2,357,310 A * 9/1944 Burchell ..... 101/127
2,444,860 A * 7/1948 Summer ..... 101/127.1
2,630,755 A * 3/1953 Herrin ..... 101/115
3,665,889 A * 5/1972 Wagnevoord ..... 118/505
5,967,031 A * 10/1999 Gauss ..... 101/115

FOREIGN PATENT DOCUMENTS

GB 237484 * 7/1925 ..... 101/128.1
GB 697955 * 10/1953 ..... 101/115
JP 155879 * 6/1994 ..... 101/115

* cited by examiner

*Primary Examiner*—Stephen R. Funk
(74) *Attorney, Agent, or Firm*—Jacobson Holman, PLLC

(57) ABSTRACT

A stencil capable of accurately transferring a picture with a plurality of colors by a person without skill. This stencil includes a plurality of die seal papers from which parts of a picture are die-cut at different positions from each other as cutting die portions which are associated with each other to form a completed picture. The bottom faces of the die seal papers are adhesive faces. The die seal papers are bonded and fixed to each other in the required ranges of the base portions thereof. After the lower die seal paper is put on an object to color the object via the cutting die portion, the lower die seal paper is peeled from the object and cut away from the base portion thereof to form a polychrome picture.

4 Claims, 5 Drawing Sheets

SEAL TYPE COMPOSITE STENCIL AND PLYCHROME PICTURE FORMING METHOD

BACKGROUND OF THE INVENTION

1. Field of The Invention

The present invention relates generally to a stencil and a method for forming a polychrome picture. More specifically, the invention relates to a seal type composite stencil for forming a picture with a plurality of colors, and a polychrome picture forming method using the same.

2. Description of Related Background Art

Conventionally, various stencils for printing a picture on the surface of a required object come into wide use. In conventional stencils, a seal having a required die-cut picture is put on the surface of an object, and a coloring paint is applied on the die-cut portion from top of the seal by means of a brush or the like. Thereafter, the seal is peeled off to make a picture, which has the same shape as the die-cut portion.

Therefore, since the conventional stencils only transcribe a single cutting die (picture) with a paint, it is only possible to obtain a monochromatic picture, so that the obtained picture is monotonous and uninteresting.

It is considered that two seals for different die-cut pictures are used for overlapping colors. However, even if it is supposed that one picture is colored twice, it is very difficult to completely match a first painted portion with a second painted portion which overlaps with the first painted portion, and it is absolutely impossible to do so by a person without skill. Thus, in the present circumstances, there have not been provided stencils capable of easily transcribing a picture with a plurality of colors.

SUMMARY OF THE INVENTION

It is therefore an object of the present invention to eliminate the aforementioned problems and to provide a seal type composite stencil capable of finely completing a picture with a plurality of colors without the shifting of the colors.

In order to accomplish the aforementioned and other objects, according to one aspect of the present invention, a seal type composite stencil comprises a plurality of die seal papers, from each of which a part of a picture is die-cut at a different position from each other to form a cutting die portion. The cutting die portions of the plurality of die seal papers are associated with each other to form a completed picture. Each of the bottom faces of the plurality of die seal papers is an adhesive face so that the plurality of die seal papers are bonded and fixed to each other in a required range of the base portions thereof. After the lower die seal paper is put on an object to color the object via the cutting die portion, the lower die seal paper is peeled from the object and cut away from the base portion thereof. Then, the same process is repeated to form a polychrome picture.

In order to allow the lower die seal paper to be easily cut away from its base portion, the lower die seal paper is preferably provided with a cutting line of perforations or the like, which is spaced from the base end of the lower die seal paper by a required distance.

If this cutting line is formed a little (about 1 to 2 mm) to the tip of the lower die seal paper from a portion of the upper die seal paper, which is bonded and fixed to the lower die seal paper, so that the back edge of the released paper on the bottom face of the upper die seal paper is exposed when the upper die seal paper is peeled from the lower die seal paper to be reversed, the back edge of the released paper of the upper die seal paper is slightly peeled from the upper die seal paper by peeling the upper die seal paper from the lower die seal paper to reverse the upper die seal paper so as to fold the upper die seal paper. In this state, if the upper die seal paper is held by a finger to be peeled off, or if the upper die seal paper is pushed by the finger cushion, the upper die seal paper can be put on the object at an accurate position while separating the released paper, so that it is possible to immediately color the object using the upper die seal paper.

In either case, even if a die seal paper, which is previously put on the object, is cut away after coloring the object using the die seal paper, the base portion of the next die seal paper is bonded and fixed to the base portion of the previously put die seal paper. Therefore, it is possible to put the next die seal paper on the object without shifting the position thereof, so that the die-cut picture is not shifted.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of the present invention will be described below.

Figure 1:
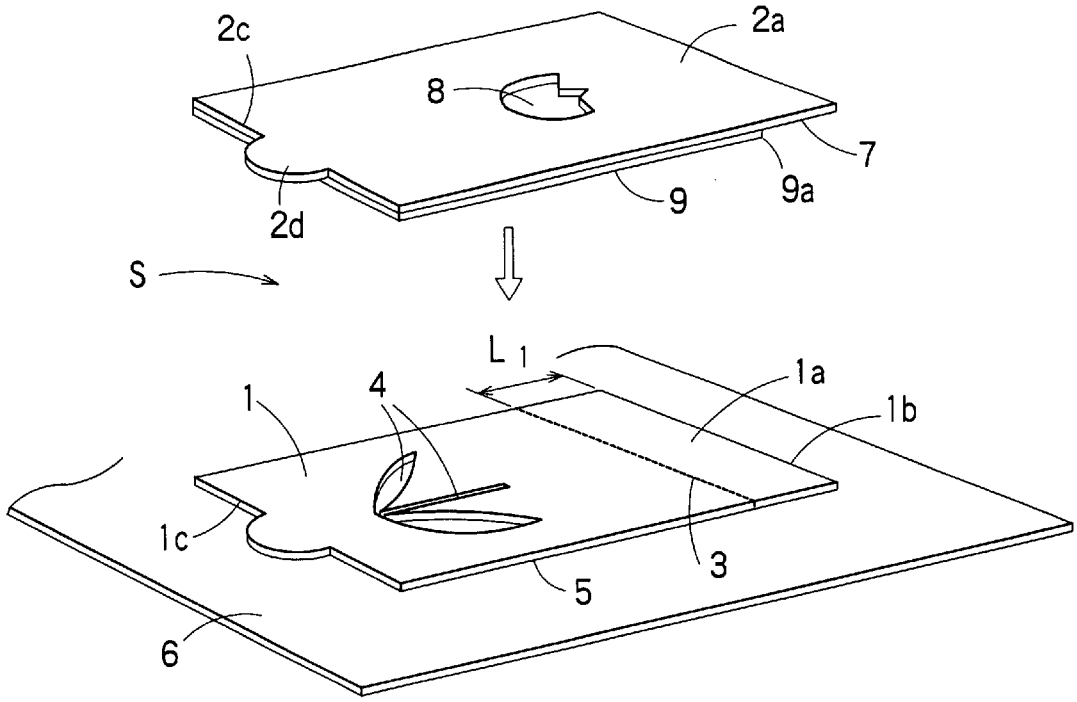
FIG. 1 is an exploded perspective view of a preferred embodiment of a seal type composite stencil according to the present invention.
Figure 2:
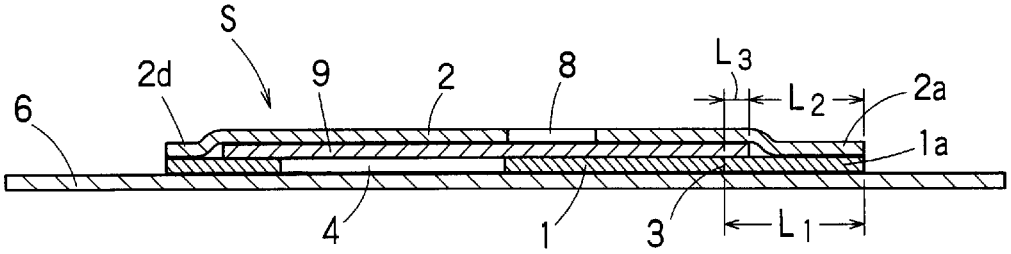
FIG. 2 is a sectional view of the stencil of FIG. 1.

In the shown embodiment, a seal type composite stencil S according to the present invention has two die seal papers for two colors. The stencil S has a four-sheet structure comprising a lower die seal paper 1, an upper die seal paper 2, and released papers which are put on the adhesive faces of the seal papers 1 and 2, respectively. The exploded perspective view of the stencil S is shown in FIG. 1, and the sectional view thereof is shown in FIG. 2.

The lower die seal paper 1 has a cutting line 3, which extends in lateral directions so as to be spaced from a base end 1*b* of a base portion 1*a* by a required distance $L_1$, (about 7 mm) and which is formed by perforations or the like, and cutting dies 4, 4, . . . (the neck and leaves of a tulip in this example) which are formed by die-cutting a part of a picture in a range toward a tip 1*c* from the cutting line 3. A pressure sensitive adhesive 5 is applied on the bottom face of the lower die seal paper 1 so that the lower die paper 1 is releasably put on a mount (a release paper) 6 before use.

The upper die seal paper 2 has the same size and shape as those of the lower die seal paper 1. A pressure sensitive adhesive 7 is applied on the bottom face of the upper die seal paper 2 so that a base portion 2*a* is bonded and fixed to the base portion 1*a* of the lower die seal paper 1 over a required length $L_2$. Thus, cutting dies 8, 8, . . . (the flower of the tulip in this example), which are formed by die-cutting a part of the picture and which are associated with the cutting dies 4 of the lower die seal paper 1 to form the completed picture, are formed in a range toward a tip 2*c*.

A release paper 9 is put on the bottom face of a portion of the upper die seal paper 2 other than a knob 2*d*, which protrudes at the center of the tip 2*c*, and the base portion 2*a* which is bonded to the lower die seal paper 1. The back edge 9*a* on the base portion side of the release paper 9 extends so as to exceed the cutting line 3 of the lower die seal paper 1 by a slight distance $L_3$ (about 1 to 2 m) toward the base portion 2*a*, so that the back edge 9*a* of the release paper 9 is easily raised from the lower die seal paper 1 to be exposed to be peeled off when the upper die seal paper 2 is reversed against the lower die seal paper 1 about the fulcrum of the bonded and fixed portion of the base portion 2*a*.

Figure 3:
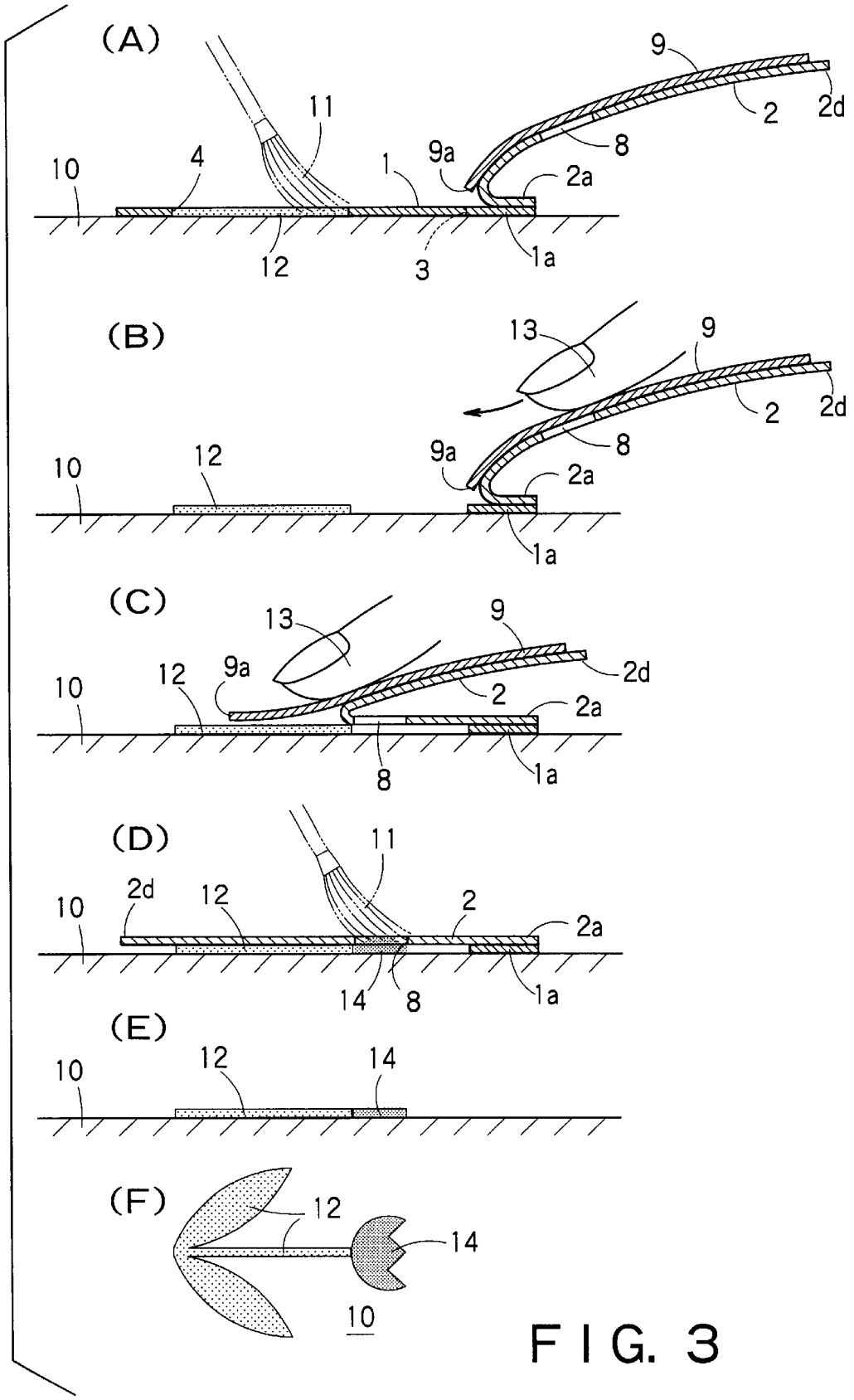
FIGS. 3(A) through 3(F) are illustrations showing the used states of the stencil of FIG. 2.

Therefore, when the stencil S is used, the stencil S is peeled from the mount 6 as shown in FIG. 3, and the lower die seal paper 1 is put on the surface of an object 10, such as a nail or a writing material, to which the part of the picture is intended to be transferred. Then, after the tip 2*c* of the upper die seal paper 2 is peeled from the lower die seal paper 1 to be reversed (FIG. 3(A)), a paint is applied from top of the lower seal paper 1 by means of the brush 11 or the like. Thus, the paint is applied on the object 10 via the cutting dies 4, 4, . . . of the lower die seal paper 1.

Then, the lower die seal paper 1 is peeled from the object 10 to be cut along the cutting line 3. Thus, as shown in FIG. 3(B), colorings 12, 12, 12 for a part of the picture are carried out on the surface of the object 10 by means of the cutting dies 4, 4, . . . of the lower die seal paper 1.

On the other hand, when the upper die seal paper 2 is reversed during the application of the paint using the lower die seal paper 1, the back edge 9*a* of the release paper 9 on the bottom face of the upper die seal paper 2 passes over the cutting line 3 of the lower die seal paper 1 to be positioned on the side of the base portion la to be exposed. Therefore, if a finger 13 is put on the release paper 9 to send the release paper 9, the upper die seal paper 2 is put on the surface of the object 10 while the release paper 9 is peeled off by itself as shown in FIGS. 3(B) through 3 (C), so that the upper die seal paper 2 is accurately put at the same position as a position, at which the lower die seal paper 1 was put (FIG. 3(D)).

Thus, if a second coloring process is carried out by means of the upper die seal paper 2 using the brush 11 similar to the above described process, the colorings 12, 12, . . . using the lower die seal paper 1 are integrated with the colorings 14, 14, . . . using the upper die seal paper 2 to draw a completed picture (FIGS. 3(E), 3(F)).

After this ends, the upper die seal paper 2, together with the base portion la of the lower die seal paper 1, which remains being put on the object 10, is peeled from the object 10 to complete the process.

Figure 4:
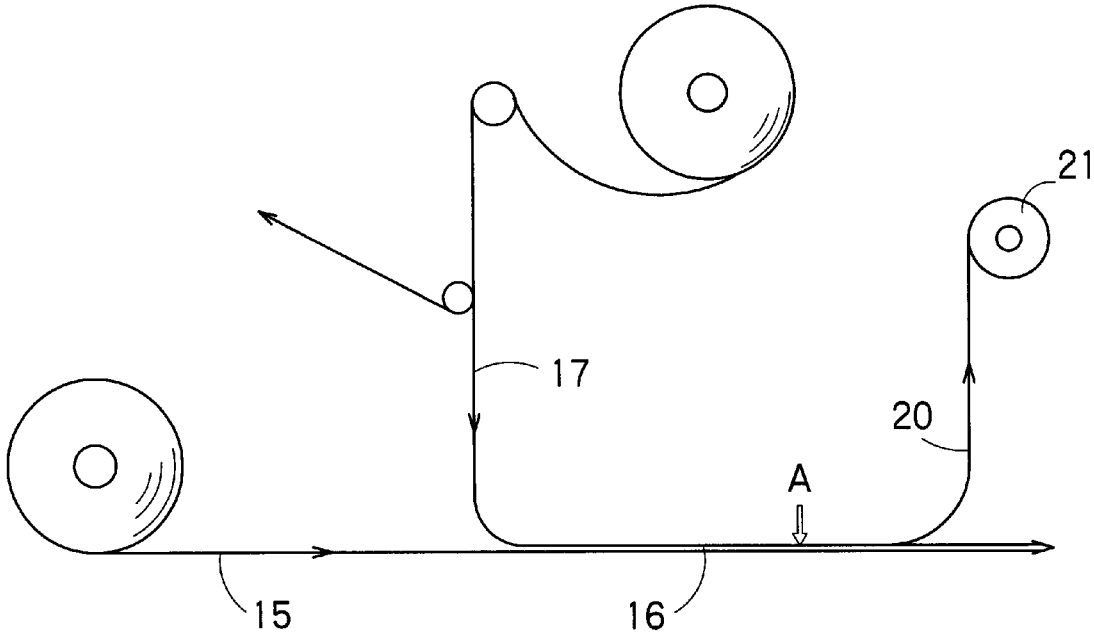
FIG. 4 is an illustration showing the flow of a sheet material, which shows an example of a producing process.
Figure 5:
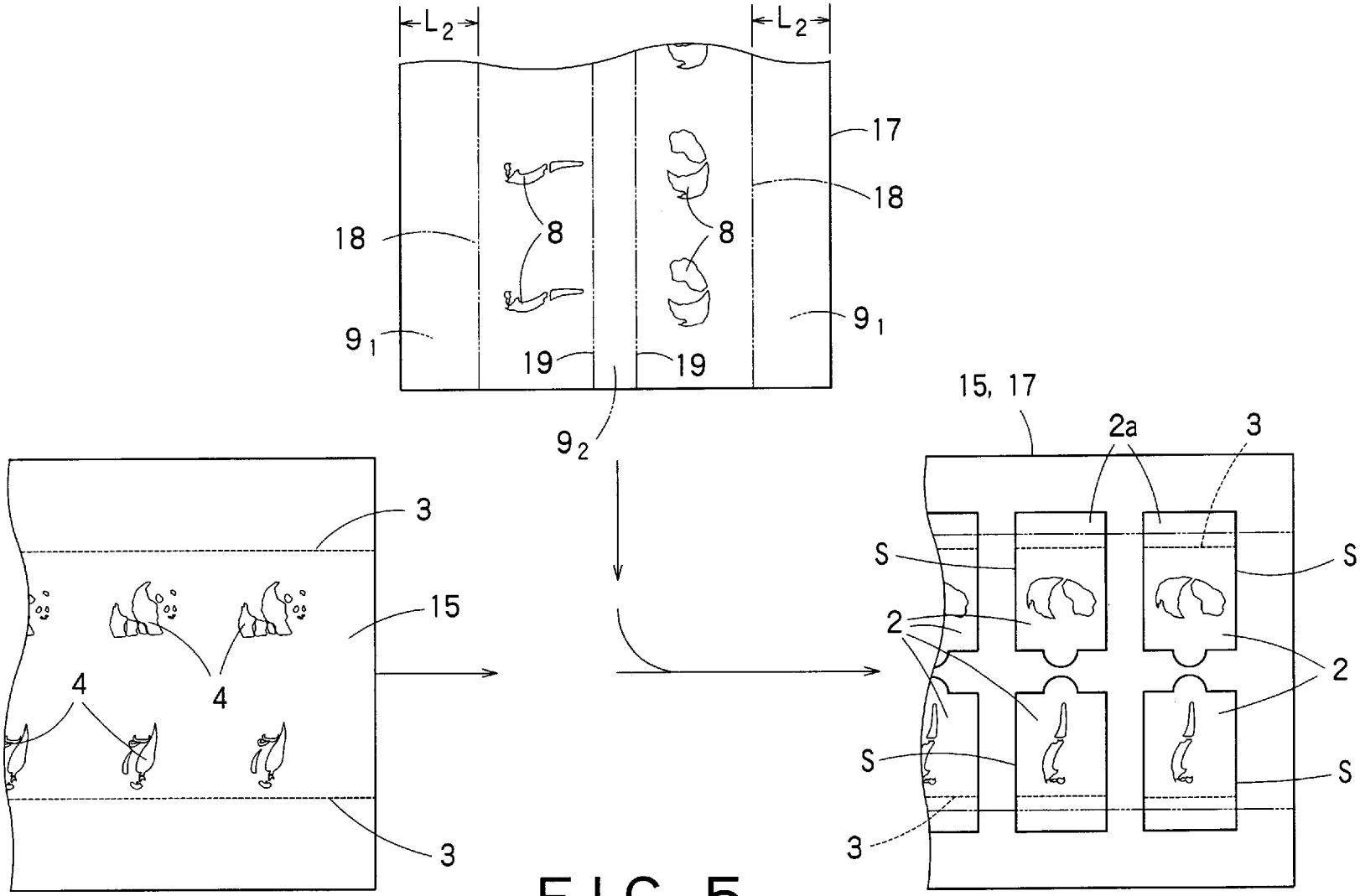
FIG. 5 is an illustration showing the state of a sheet material of FIG. 4.

FIGS. 4 and 5 show an example of a process suitable for the production of the stencil S. These figures show the case where two kinds of stencils are simultaneously produced in parallel, In a strip-like sheet material 15, from which the lower die seal paper 1 is made, the die cutting (the cutting die 4 in FIG. 1) of a part of a picture and the required print are previously carried out. In addition, the cutting lines 3, 3 are formed thereon. This sheet material 15 is wound in the form of a roll, and extended to be fed to an alignment station 16.

In a strip-like sheet material 17, from which the upper die seal paper 2 is made, the die cutting (the cutting die 8 in FIG. 1) of a part of a picture and the required print are previously carried out. In the release paper 9, which is put on the adhesive face 7 on the bottom face, slits 18, 18 are formed so as to be spaced from both edges of the sheet material 17 by distances $L_2$, $L_2$ (corresponding to the distance $L_1$ in FIG. 2), and slits 19, 19 are formed at the central portion so as to overlap with the knob 2*d* of the tip 2*c* of the upper die seal paper 2. Both side release paper sections $9_{1\ 91}$ and a central release paper section $9_2$ are peeled off at a position (position A in FIG. 4) before the upper sheet material 2 is combined with the lower sheet material 1.

Therefore, when the upper and lower sheet materials 15, 17 are combined in the alignment station 16, both are bonded on the side of the base portion la from the cutting lines 3, 3 of the lower sheet material 15 (in the range of $L_2$ in FIG. 2), and a portion corresponding to the knob 2*d* of the tip 2*c* of the upper die seal paper 2 is put on the central peeled adhesive face.

Thus, in the alignment station 16, the shape of the stencil S is die-cut except for the mount, and a strip 20 is peeled from the upper sheet material 17 to be wound onto a winding part 21 to be recovered.

Therefore, the completed stencils S, S, . . . are continuously produced so as to be arranged on the sheet materials 15, 17 at regular intervals as shown on the right side of FIG. 5. In the post-process, the sheet materials 15, 17 are cut into parts, each of which includes 10 stencils S as goods.

Figure 6:
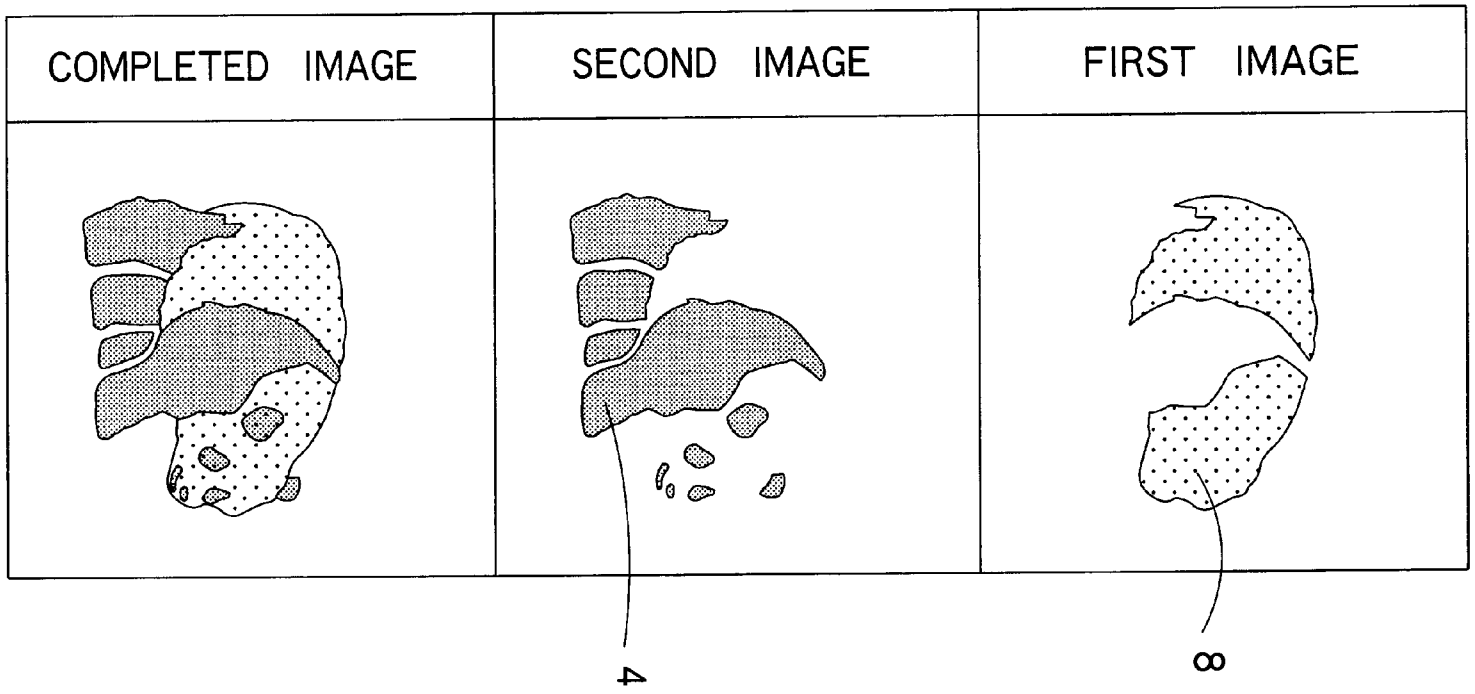
FIG. 6 is an image view showing another example of a picture.

FIG. 6 is an image view of a picture (a panda) which is made by means of the cutting dies 4 and 8 which are shown as a picture of one of the stencils of FIG. 5.

While the die seal papers 1, 2 have had a two-sheet structure of upper and lower papers in the shown embodiment, the number of the lower seal papers 1 may be increased to two or more, so that it is possible to easily realize a polychrome picture including three or more colors.

As described above, according to the present invention, the base portions of the upper and lower die seal papers are bonded and fixed to each other. After the lower die seal paper is put on the object, the upper die seal paper is peeled off to be reversed. Then, after the cutting die of the lower die seal paper is used for carrying out a coloring process, the lower die seal paper is cut away from the base portion. Subsequently, the upper die seal paper is returned onto the object to be put thereon to be used for carrying out a coloring process. Therefore, even if a plurality of coloring processes are carried out, the cutting dies are not shifted, so that it is possible to finely form a picture with a plurality of colors without skill and without meeting with failure.

In addition, it is possible to easily cut away the used lower die seal paper, and it is possible to easily peel and remove the release paper of the upper die seal paper, so that there is a remarkable advantage in that operation can be more easily carried out.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A seal type composite stencil comprising a plurality of die seal papers, wherein a bottom face of each of said plurality of die seal papers includes adhesive, each of said plurality of die seal papers having a cutting die portion which is formed by die-cutting a part of a picture, said plurality of die seal papers being bonded and fixed to each other in a required range of each of base portions thereof, and said cutting die portion of each of said plurality of die seal papers being arranged at a different position from other cutting die portions, and associated with other cutting die portions to form a completed picture, and wherein after a lowermost one of said plurality of die seal papers is put on an object to color a region in said cutting die portion of said lowermost one of said plurality of die seal papers, said lowermost one of said plurality of die seal papers is peeled from said object and cut away from said base portion, and then, the next lower one of said plurality of die seal papers is similarly put on said object to color a region in said cutting die portion of said next lower one of said plurality of die seal papers to form at least another region of the completed picture.

2. A seal type composite stencil as set forth in claim 1, wherein said plurality of die seal papers includes:

a lower die seal paper, from which a part of said picture is die-cut, said lower die seal paper being provided with a cutting line of perforations, which is spaced from a base end of said lower die seal paper by a predetermined distance; and an upper die seal paper which is bonded to a portion of the top face of said lower die seal paper, said upper die seal paper having a release paper which is put on a portion of said upper die seal paper other than said portion having the required width, a part of a tip of said upper die seal paper being bonded to said lower die seal paper, and said upper die seal paper having said die cutting corresponding to a part of said picture which is associated with said part of said picture of said lower die seal paper to form said picture.

3. A seal type composite stencil as set forth in claim 2, wherein said cutting line of said lower die seal paper is formed closer to the tip than a portion of said upper die seal paper which is bonded and fixed to said lower die seal paper, and a back end of the release paper on the bottom face of said upper die seal paper is exposed when said upper die seal paper is peeled from said lower die seal paper.

4. A method for forming a polychrome picture on a surface of an object by a seal type composite stencil comprising a plurality of die seal papers, wherein a bottom face of each of said plurality of die seal papers includes adhesive , each of said plurality of die seal papers having a cutting die portion which is formed by die-cutting a part of a picture, said plurality of die seal papers being bonded and fixed to each other in a required range of each of base portions thereof, and said cutting die portion of each of said plurality of die seal papers being arranged at a different position from other cutting die portions, and associated with other cutting die portions to form the polychrome picture, said method comprising the steps of:

putting the lowermost one of said plurality of die seal papers on said object;

coloring a region in said cutting die portion of said lowermost one of said plurality of die seal papers, and thereafter, peeling said lowermost one of said plurality of die seal papers from said object and cutting away said lowermost one of said plurality of die seal papers from said base portion, and then, similarly putting the next lower one of said plurality of die seal papers on said object to color a region in said cutting die portion of said next lower one of said plurality of die seal papers to form the polychrome picture.

* * * * *